US009373314B2

(12) United States Patent
Takahashi et al.

(10) Patent No.: US 9,373,314 B2
(45) Date of Patent: Jun. 21, 2016

(54) INSTALLATION STRUCTURE FOR ACOUSTIC TRANSDUCER

(71) Applicant: YAMAHA CORPORATION, Hamamatsu-shi, Shizuoka-ken (JP)

(72) Inventors: Yuji Takahashi, Hamamatsu (JP); Kenta Ohnishi, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/762,611

(22) PCT Filed: Dec. 27, 2013

(86) PCT No.: PCT/JP2013/085055

§ 371 (c)(1),
(2) Date: Jul. 22, 2015

(87) PCT Pub. No.: WO2014/115482

PCT Pub. Date: Jul. 31, 2014

(65) Prior Publication Data

US 2015/0356961 A1 Dec. 10, 2015

(30) Foreign Application Priority Data

Jan. 22, 2013 (JP) ..... 2013-009268

(51) Int. Cl.
*G10H 3/14* (2006.01)
*G10H 1/32* (2006.01)
(Continued)

(52) U.S. Cl.
CPC . *G10H 1/32* (2013.01); *G10H 3/22* (2013.01); *H04R 9/02* (2013.01); *G10H 2250/451* (2013.01); *H04R 7/045* (2013.01); *H04R 2440/05* (2013.01)

(58) Field of Classification Search
CPC ..... G10H 1/32; G10H 3/22; G10H 2250/451; H04R 9/02; H04R 7/045; H04R 2240/05; H04R 2240/07
USPC ..... 84/725
See application file for complete search history.

(56) References Cited

U.S. PATENT DOCUMENTS 7,085,391 B1 8/2006 Yamaya

FOREIGN PATENT DOCUMENTS

JP 59500531 A 3/1984
JP 04500735 A 2/1992
(Continued)

OTHER PUBLICATIONS

International Search Report issued in PCT/JP2013/085055, mailed Mar. 4, 2014. English translation provided.
(Continued)

*Primary Examiner* — Jeffrey Donels
(74) *Attorney, Agent, or Firm* — Rossi, Kimms & McDowell LLP

(57) ABSTRACT

An installation structure for an acoustic transducer for vibrating a vibrated body in a first direction includes a magnetic-path forming portion; a movable unit having an electromagnetic coupling portion and configured to vibrate in the first direction; an attachment portion which attaches the magnetic-path forming portion to a fixed portion; a connector connected to the vibrated body and connecting the movable unit to the vibrated body; and a displacement permitting mechanism configured to permit electromagnetic coupling between the magnetic-path forming portion and the electromagnetic coupling portion to be maintained and to permit the vibration of the movable unit to be transmitted to the vibrated body when the connector is displaced with respect to the fixed portion within a predetermined range in an intersecting direction that intersects the first direction. The displacement permitting mechanism is provided at at least one of the attachment portion, the movable unit, and the connector.

5 Claims, 10 Drawing Sheets

(51) Int. Cl.

| | |
|---|---|
| ***H04R 9/02*** | (2006.01) |
| ***G10H 3/22*** | (2006.01) |
| *H04R 7/04* | (2006.01) |

(56) References Cited

FOREIGN PATENT DOCUMENTS

| | | | |
|---|---|---|---|
| JP | 2000315088 | A | 11/2000 |
| JP | 2008298992 | A | 12/2008 |
| JP | 2012230406 | A | 11/2012 |
| TW | 466468 | B | 12/2001 |
| WO | 8303022 | A1 | 9/1983 |
| WO | 9003025 | A1 | 3/1990 |
| WO | 0054250 | A1 | 9/2000 |

OTHER PUBLICATIONS

Written Opinion issued in PCT/JP2013/085055, mailed Mar. 4, 2014. English translation provided.

Office Action issued in TW102147003, mailed Mar. 24, 2015. English translation provided.

INSTALLATION STRUCTURE FOR ACOUSTIC TRANSDUCER

TECHNICAL FIELD

The present invention relates to an installation structure for an acoustic transducer configured to operate in accordance with an audio signal for thereby vibrating a vibrated body so as to permit the vibrated body to generate sounds.

BACKGROUND ART

Conventional devices such as keyboard musical instruments are known in which an acoustic transducer operates in accordance with an audio signal to thereby vibrate a vibrated body, so that the vibrated body generates sounds. For instance, in a keyboard musical instrument, the acoustic transducer is fixed to a back post via a support member, and a movable unit is connected to a soundboard that functions as the vibrated body to be vibrated. The movable unit is configured to vibrate when an electric current based on the audio signal is supplied to a coil. The vibration of the movable unit is transmitted to the soundboard, so that the soundboard is vibrated to thereby generate sounds.

The following Patent Literature 1 describes an installation structure for the acoustic transducer in the keyboard musical instrument. In the disclosed structure, the movable unit in the form of a rod-like hammer is electromagnetically coupled to a magnetic-path forming portion having a magnet, a core, and so on. When an electric current is supplied to the coil, the movable unit reciprocates in its axial direction, so that the movable unit vibrates. The movable unit is fixedly bonded at its distal end portion to a flange fixed to the soundboard.

CITATION LIST

Patent Literature

Patent Literature 1: Japanese Unexamined Patent Application Publication (Translation of PCT Application) 04-500735

SUMMARY OF INVENTION

Technical Problem

The vibrated body such as the soundboard may undergo a dimensional change or deformation due to changes over time by influences of the temperature and the humidity. In particular when the vibrated body is displaced in the horizontal direction perpendicular to a vibration direction in which the movable unit vibrates and the flange is accordingly displaced in the horizontal direction, the distal end portion of the movable unit is displaced in the horizontal direction, together with the flange. When the amount of displacement becomes large to a certain extent, the movable unit and the magnetic-path forming portion may physically interfere with each other or electromagnetic coupling therebetween may fail, causing operation failure of the movable unit. In this instance, there may be a risk that the vibration is not properly transmitted and thus sounds are not properly generated. That is, the function of the acoustic transducer to vibrate the vibrated body cannot be maintained.

The present invention has been developed to solve the conventionally experienced problems. It is therefore an object of the invention to provide an installation structure for an acoustic transducer that enables a vibrating function of the acoustic transducer with respect to the vibrated body to be maintained even when the vibrated body undergoes a dimensional change in a direction perpendicular to a vibration direction in which the movable unit vibrates.

Solution to Problem

The above-indicated object may be attained according to a principle of the invention, which provides an installation structure for an acoustic transducer (50) configured to operate in accordance with an audio signal for thereby vibrating a vibrated body (7) in a first direction, comprising:

- a magnetic-path forming portion (52) forming a magnetic path;
- a movable unit (100) having an electromagnetic coupling portion (EM, 511, 512, 513) electromagnetically coupled to the magnetic-path forming portion, the movable unit being configured to vibrate in the first direction when the electromagnetic coupling portion is driven by the magnetic-path forming portion in response to a drive signal based on the audio signal;
- an attachment portion (55) which attaches the magnetic-path forming portion to a fixed portion (9);
- a connector (110) connected to the vibrated body, the connector connecting the movable unit to the vibrated body fixedly in the first direction for transmitting vibration of the movable unit to the vibrated body; and
- a displacement permitting mechanism configured such that, when the connector is displaced with respect to the fixed portion within a predetermined range in an intersecting direction that intersects the first direction, the displacement permitting mechanism permits electromagnetic coupling between the magnetic-path forming portion and the electromagnetic coupling portion to be maintained and permits the vibration of the movable unit to be transmitted to the vibrated body,
- wherein the displacement permitting mechanism is provided at at least one of the attachment portion, the movable unit, and the connector.

The installation structure for the acoustic transducer may be constructed as follows.

In the installation structure for the acoustic transducer constructed as described above, the movable unit may include a rod member (101) having a first end portion (101*a*) connected to the electromagnetic coupling portion, and the displacement permitting mechanism may be configured such that, when the connector is displaced with respect to the fixed portion within the predetermined range, the displacement permitting mechanism permits the rod member to be relatively displaced or deformed with respect to the electromagnetic coupling portion in the intersecting direction.

In the installation structure for the acoustic transducer constructed as described above, the movable unit (100) may include a rod member (101) having a first end portion (101*a*) connected to the electromagnetic coupling portion (52) and a second end portion (101*b*) connected to the connector (110), the displacement permitting mechanism may be provided at the connector, and the displacement permitting mechanism may be configured such that, when the connector is displaced with respect to the magnetic-path forming portion within the predetermined range in the intersecting direction, the displacement permitting mechanism permits the second end portion of the rod member to be connected to the connector in a state in which the rod member is inclined with respect to the first direction.

In the installation structure for the acoustic transducer constructed as described above, the displacement permitting mechanism may be a joint structure having: a spherical portion (102) provided at the second end portion of the rod member; and at least one contact surface (111*a*, 112*a*) formed on the connector and held in contact with the spherical portion when the connector is displaced with respect to the magnetic-path forming portion within the predetermined range in the intersecting direction.

In the installation structure for the acoustic transducer constructed as described above, the rod member of the movable unit may be divided at least into a first portion (101-2) and a second portion (101-1, 101-3), the first portion and the second portion may be connected to each other by a connect portion (104) so as to vibrate together as a unit, the displacement permitting mechanism may be provided at the connect portion of the movable unit, and the connect portion permits the second portion to be inclined relative to the first portion even when the connector (110) is displaced with respect to the fixed portion within the predetermined range.

In the installation structure for the acoustic transducer constructed as described above, the displacement permitting mechanism may be provided at a first-end-portion connector (120) connecting the electromagnetic coupling portion and the first end portion of the rod member in the movable unit, and the first-end-portion connector may be configured to permit at least a portion of the rod member near to the first end portion to be inclined with respect to the first direction when the connector (110) is displaced with respect to the fixed portion within the predetermined range.

In the installation structure for the acoustic transducer constructed as described above, the displacement permitting mechanism may be provided at the attachment portion, the attachment portion may be interposed between the fixed portion and the magnetic-path forming portion such that the fixed portion and the magnetic-path forming portion are displaceable relative to each other in the intersecting direction, and the attachment portion may be configured such that, when the connector is displaced with respect to the fixed portion within the predetermined range, the attachment portion permits the magnetic-path forming portion to be displaced with respect to the fixed portion in the intersecting direction.

In the installation structure for the acoustic transducer constructed as described above, the rod member of the movable unit may be a flexible shaft and may be configured such that, when the connector (110) is displaced with respect to the fixed portion within the predetermined range, the rod member is bent so as to function as the displacement permitting mechanism.

In the installation structure for the acoustic transducer constructed as described above, the displacement permitting mechanism may be at least one joint structure (104) provided at the movable unit.

In the installation structure for the acoustic transducer constructed as described above, the displacement permitting mechanism may be constituted by a plurality of joint structures (104) provided at at least one of the connector and the movable unit.

The reference numerals in the brackets attached to respective constituent elements in the above description are used by way of example.

Advantageous Effects of Invention

According to the installation structure for the acoustic transducer of the present invention, it is possible to maintain the vibrating function of the acoustic transducer with respect to the vibrated body even when the vibrated body undergoes a dimensional change in the direction intersecting the vibration direction of the movable unit.

DESCRIPTION OF EMBODIMENT

Figure 1:
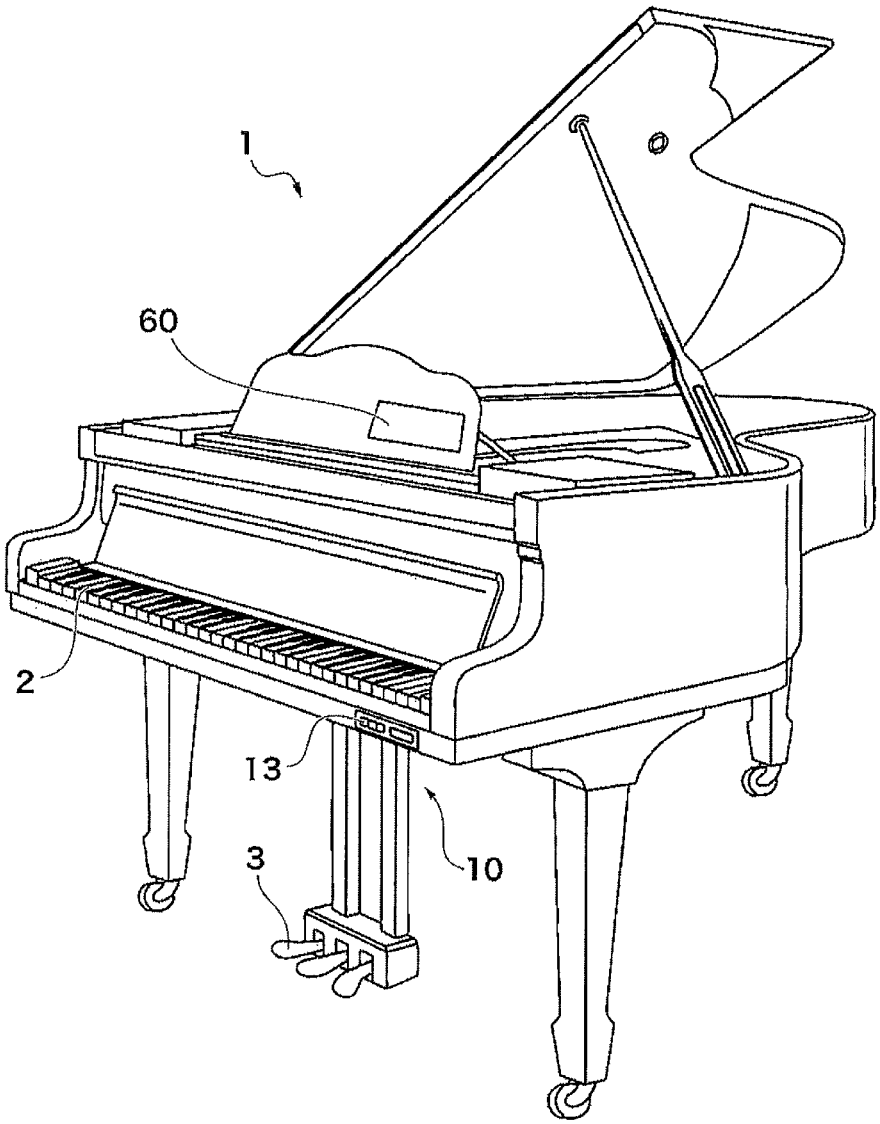
FIG. 1 is a perspective view showing an external appearance of a grand piano to which is applied an installation structure for an acoustic transducer according to one embodiment of the invention.

There will be hereinafter explained one embodiment of the invention referring to the drawings.

FIG. 1 is a perspective view showing an external appearance of a grand piano to which is applied an installation structure for an acoustic transducer according to one embodiment of the invention.

In the present embodiment, a musical instrument in the form of a grand piano 1 is illustrated as one example of devices and musical instruments to which is applied an installation structure for an acoustic transducer. The acoustic transducer is configured to operate in accordance with an audio signal for thereby vibrating a vibrated body, so as to permit the vibrated body to generate sounds. A soundboard 7 is illustrated as one example of the vibrated body to be vibrated. It is noted the devices to which the present installation structure is applied is not limited to the grand piano 1 and the vibrated body is not limited to the soundboard 7. That is, the invention is applicable to any structure in which the acoustic transducer is driven in accordance with a drive signal based on the audio signal and the vibrated body is thereby vibrated for generating sounds.

The grand piano 1 has a keyboard and pedals 3 on its front side. The keyboard has a plurality of keys 2 that are operated by a performer (user) for performance. The grand piano 1 further has a controller 10 having an operation panel 13 on its front surface portion and a touch panel 60 provided on a music stand. User's instructions can be input to the controller 10 by user's operations on the operation panel 13 and the touch panel 60.

Figure 2:
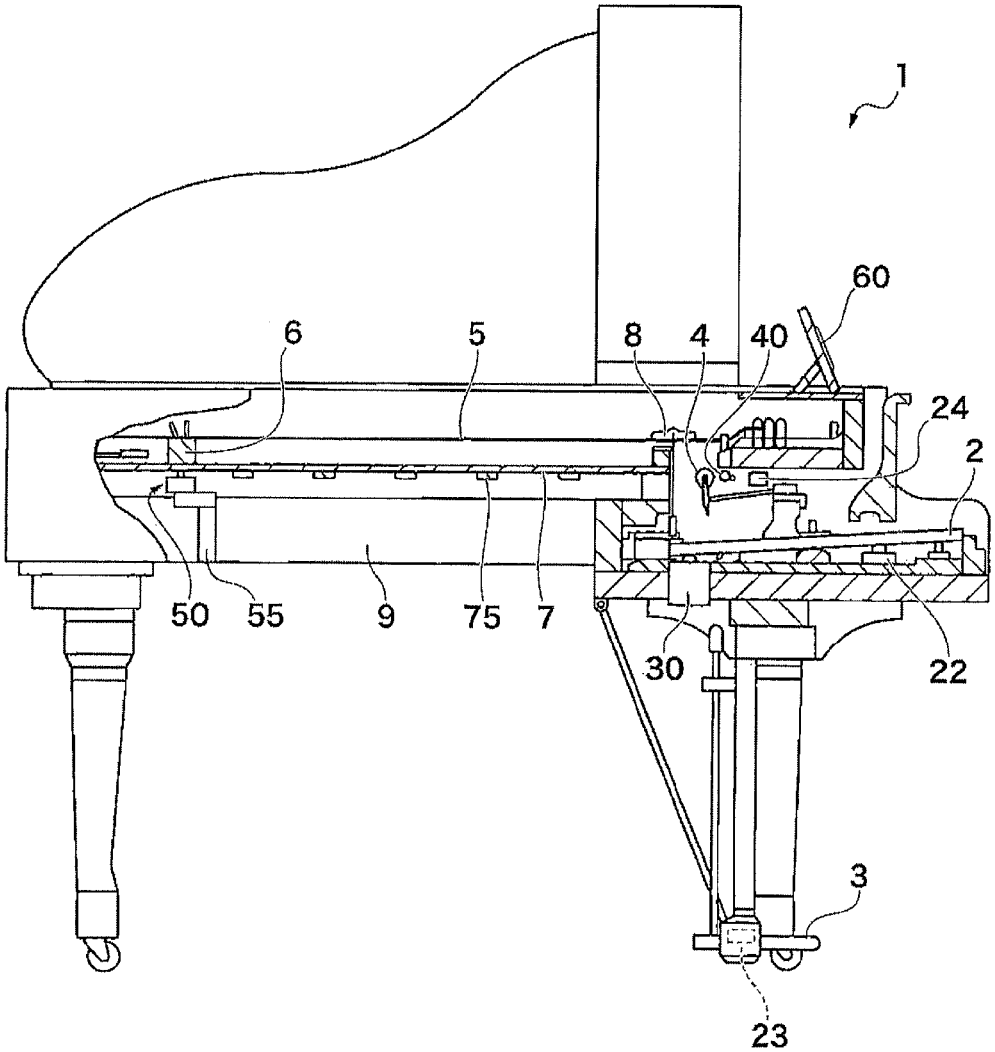
FIG. 2 is a cross-sectional view showing an internal structure of the grand piano.

FIG. 2 is a cross-sectional view showing an internal structure of the grand piano 1.

In FIG. 2, structures provided for each of the keys 2 are illustrated focusing on one key 2, and illustration of the structures for other keys 2 is omitted. A key drive unit 30 is provided below a rear end portion of each key 2 (i.e., on a rear side of each key 2 as viewed from the user who plays the piano 1 on the front side of the piano 1). The key drive unit 30 drives the corresponding key 2 using a solenoid.

The key drive unit 30 drives the solenoid in accordance with a control signal sent from the controller 10. That is, the key drive unit 30 drives the solenoid such that a plunger moves upward to reproduce a state similar to that when the user has depressed the key and such that the plunger moves downward to reproduce a state similar to that when the user has released the key.

Strings 5 and hammers 4 are provided so as to correspond to the respective keys 2. When one key 2 is depressed, the corresponding hammer 4 pivots via an action mechanism (not shown), so as to strike the string(s) 5 provided for the key 2. A damper 8 moves in accordance with a depression amount of the key 2 and a step-on amount of a damper pedal among the pedals 3, such that the damper 8 is placed in a non-contact state in which the damper 8 is not in contact with the string(s) 5 or in a contact state in which the damper 8 is in contact with the string(s) 5. (Hereinafter, the "pedal 3" may refer to the damper pedal where appropriate.) A stopper 40 operates when a string-striking preventive mode is set. More specifically, the stopper 40 receives the corresponding hammer 4, thereby preventing the string(s) 5 from being struck by the hammer 4.

Key sensors 22 are provided for the respective keys 2. Each key sensor 22 is disposed below the corresponding key 2 to output, to the controller 10, a detection signal in accordance with the behavior of the corresponding key 2. Hammer sensors 24 are provided for the respective hammers 4. Each hammer sensor 24 outputs, to the controller 10, a detection signal in accordance with the behavior of the corresponding hammer 4. Pedal sensors 23 are provided for the respective pedals 3. Each pedal sensor 23 outputs, to the controller 10, a detection signal in accordance with the behavior of the corresponding pedal 3.

While not shown, the controller 10 includes a CPU, a ROM, a RAM, a communication interface, and so on. The CPU executes control programs stored in the ROM for enabling the controller 10 to perform various controls.

The soundboard 7 is a wooden plate-shaped member, and soundboard ribs 75 and bridges 6 are attached to the soundboard 7. The strings 5 stretched under tension partially engage the bridges 6. In this structure, vibration of the soundboard 7 is transmitted to the strings 5 via the bridges 6 while vibration of the strings 5 is transmitted to the soundboard 7 via the bridges 6.

In the grand piano 1, acoustic transducers 50 are connected to the soundboard 7 such that each acoustic transducer 50 is supported by a corresponding support member 55 connected to a back post 9. Each support member 55 is formed of metal such as an aluminum material. The back posts 9 cooperate with a frame to support the tension of the strings 5 and constitute a part of the grand piano 1.

Figure 3:
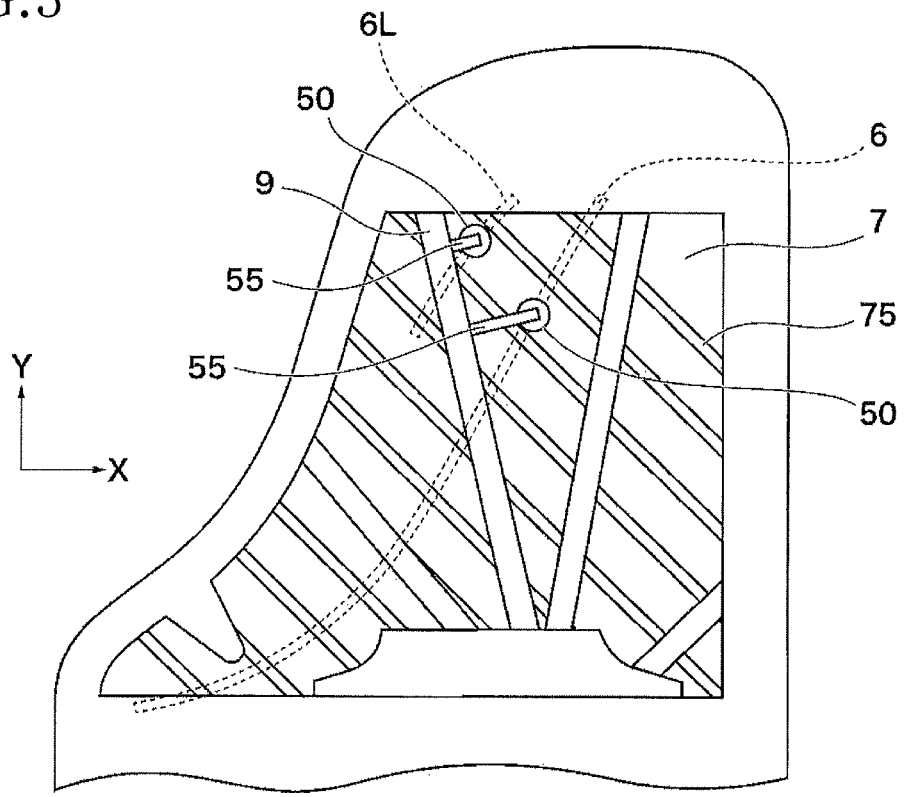
FIG. 3 is a view showing a back surface of a soundboard for explaining positions at which the acoustic transducers are installed.

FIG. 3 is a view showing a back surface of the soundboard 7 for explaining positions at which the acoustic transducers 50 are installed.

Each acoustic transducer 50 is connected to the soundboard 7 between adjacent two of a plurality of soundboard ribs 75. In FIG. 3, a plurality of acoustic transducers 50, e.g., two acoustic transducers 50 having the same structure are connected to the soundboard 7. Only one acoustic transducer 50 may be connected to the soundboard 7. Each acoustic transducer 50 is disposed at a position as close as possible to the bridge 6. In the present embodiment, the acoustic transducer 50 is disposed at a position of the back surface of the soundboard 7 at which the acoustic transducer 50 is opposed to the bridge 6 with the soundboard 7 interposed therebetween. In the following explanation, a left-right direction, a front-rear direction, and an up-down (vertical) direction of the grand piano 1 are respectively referred to as "X direction", "Y direction", and "Z direction". The Z direction is one example of a first direction. The X-Y direction is the horizontal direction.

Figure 4:
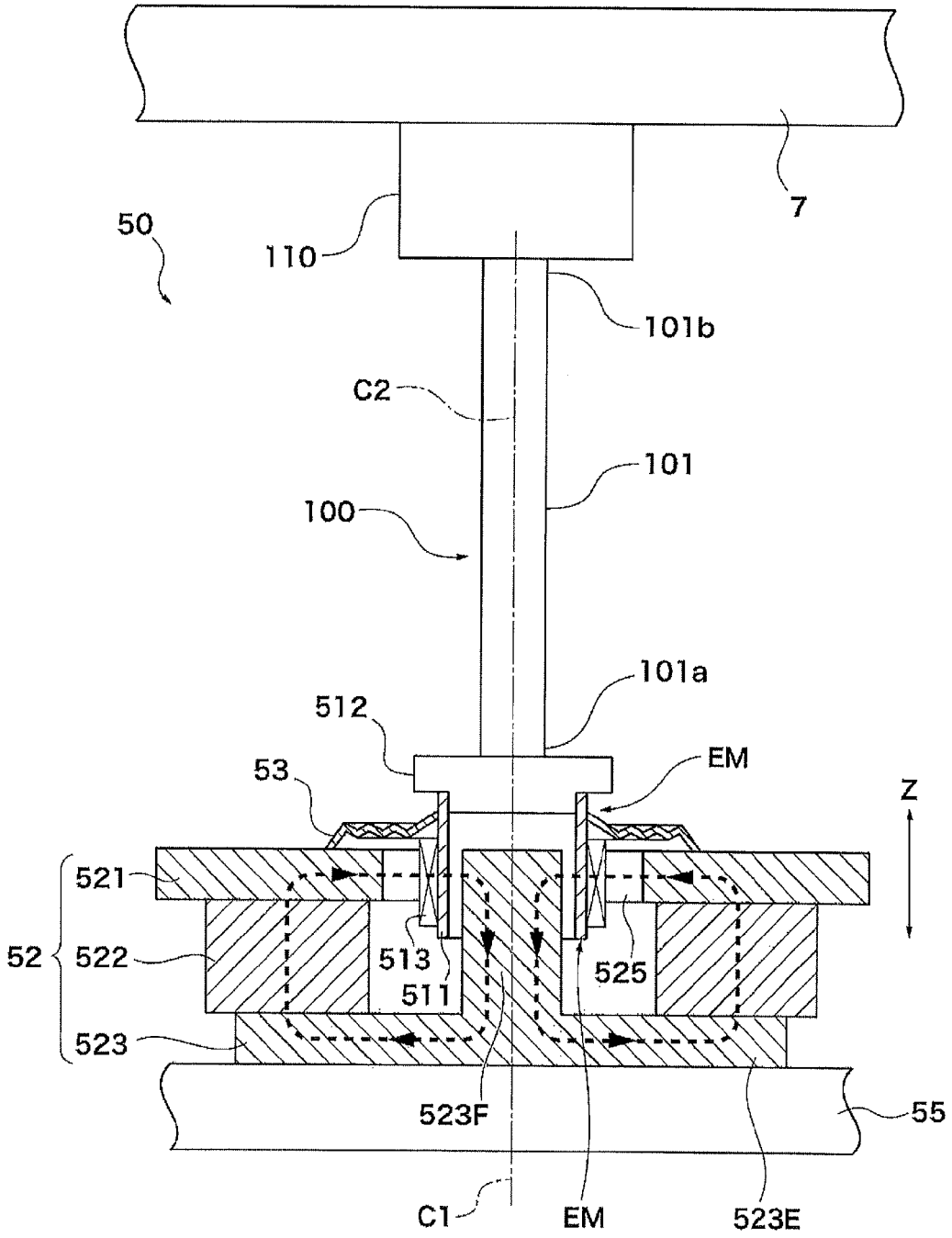
FIG. 4 is a vertical sectional view showing the acoustic transducer.

As shown in the vertical sectional view of FIG. 4, the acoustic transducer 50 is an actuator of a voice-coil type and is mainly constituted by a magnetic-path forming portion 52 and a movable unit 100. The movable unit 100 includes a rod member 101, a cap 512, a bobbin 511, and a voice coil 513. The bobbin 511 having an annular shape is fixedly fitted on a lower portion of the cap 512 with a slight space left therebetween. The voice coil 513 is constituted by conductor wires wound around the outer circumferential surface of the bobbin 511. The voice coil 513 converts, into vibration, changes in an electric current flowing in a magnetic field formed by the magnetic-path forming portion 52. The cap 512, the bobbin 511, and the voice coil 513 constitute an electromagnetic coupling portion EM that is electromagnetically coupled to the magnetic-path forming portion 52.

A first end portion 101*a*, which is a lower end portion of the rod member 101, is fixedly connected to the cap 512 of the electromagnetic coupling portion EM and extends in the Z direction (the up-down direction). A second-end-portion connector 110 is fixed to a lower (back) surface of the soundboard 7. The second-end-portion connector 110 connects an upper end portion, namely, a second end portion 101*b*, of the rod member 101 to the soundboard 7 fixedly in the Z direction, so as to transmit vibration of the movable unit 100 to the soundboard 7.

The magnetic-path forming portion 52 includes a top plate 521, a magnet 522, and a yoke 523 which are arranged in this order from the upper side. The electromagnetic coupling portion EM is supported by a damper 53 such that the electromagnetic coupling portion EM can be displaced in the Z direction without contacting the magnetic-path forming portion 52. The damper 53 is formed of fiber or the like and has a disc-like shape. The damper 53 has a waved shape like bellows at its disc-like portion. The damper 53 is attached at its outer peripheral end to the upper surface of the top plate 521 and at its inner peripheral end to the electromagnetic coupling portion EM.

The magnetic-path forming portion 52 is in a fixed state relative to the back post 9 such that the yoke 523 is fixed to the support member 55 by screws or the like, for instance. Thus, the support member 55 has a function of attaching the magnetic-path forming portion 52 to the back post 9 as a fixed portion.

The top plate 521 is formed of a soft magnetic material such as soft iron and has a disc-like shape having a central hole. The yoke 523 is formed of a soft magnetic material such as soft iron. The yoke 523 is constituted by a disc portion 523E and a cylindrical portion 523F having an outer diameter smaller than that of the disc portion 523E. The disc portion 523E and the cylindrical portion 523F are formed integrally such that the axes of the disc portion 523E and the cylindrical portion 523F are aligned with each other. The outer diameter of the cylindrical portion 523F is smaller than an inner diameter of the top plate 521. The magnet 522 is a doughnut-shaped permanent magnet and has an inner diameter larger than the inner diameter of the top plate 521.

The axes of the top plate 521, the magnet 522, and the yoke 523 are aligned with one another and coincide with an axis C1 of the magnetic-path forming portion 52. This arrangement forms a magnetic path shown by arrows in the broken line in FIG. 4. The electromagnetic coupling portion EM is disposed such that the voice coil 513 is located in a space between the top plate 521 and the cylindrical portion 523F, i.e., in a magnetic-path space 525. In this instance, the electromagnetic coupling portion EM is positioned in the horizontal direction (the X-Y direction) by the damper 53 such that an axis C2 of the rod member 101 coincides with the axis C 1 of the magnetic-path forming portion 52.

A drive signal based on an audio signal is input from the controller 10 to the acoustic transducer 50. For instance, audio data stored in a storage portion (not shown) is read out by the controller 10, and the drive signal is generated on the basis of the read data. Alternatively, when the soundboard 7 is vibrated in accordance with a performance operation, the behaviors of the keys 2, the pedals 3, and the hammers 4 are detected respectively by the key sensors 22, the pedal sensors 23, and the hammer sensors 24, whereby the performance operation of the player is detected. On the basis of the detection results, the controller 10 generates performance information. The controller 10 subsequently generates an acoustic signal on the basis of the performance information. The acoustic signal is processed and amplified so as to be output to the acoustic transducer 50 as the drive signal.

When the drive signal is input to the voice coil 513, the voice coil 513 receives a magnetic force in the magnetic-path space 525, and the bobbin 511 receives a drive force in the Z direction in accordance with the waveform indicated by the drive signal input to the voice coil 513. Consequently, the electromagnetic coupling portion EM is driven by the magnetic-path forming portion 52, so that the electromagnetic coupling portion EM and the rod member 101 vibrate together as a unit in the Z direction.

When the movable unit 100 vibrates in the Z direction, the vibration of the movable unit 100 is transmitted to the soundboard 7 by the second-end-portion connector 110, so that the soundboard 7 is vibrated and sounds generated by the vibration of the soundboard 7 are emitted in the air.

Incidentally, when the soundboard 7 undergoes a dimensional change or deformation due to changes over time or the like, the second-end-portion connector 110 may also be displaced in the horizontal direction together with the soundboard 7. It is the most preferable that the axis C2 of the rod member 101 and the axis C1 of the magnetic-path forming portion 52 be coaxial or concentric with each other. However, when the second-end-portion connector 110 is displaced in the horizontal direction, the position of the electromagnetic coupling portion EM cannot be retained by the damper 53, so that the positional relationship between the electromagnetic coupling portion EM and the magnetic-path forming portion 52 may become improper.

In view of the above, it is necessary to provide a displacement permitting mechanism configured to permit electromagnetic coupling between the magnetic-path forming portion 52 and the electromagnetic coupling portion EM to be properly maintained and to permit vibration of the movable unit 100 to be properly transmitted to the soundboard 7 even when the second-end-portion connector 110 is displaced with respect to the back post 9 within a predetermined range.

It is rather difficult to realize such necessity at an initial stage of usage of the product. In addition, it is necessary to conceive a mechanism that enables the vibration transmitting function in the Z direction to be maintained while absorbing the dimensional change in the horizontal direction. To attain such a mechanism, a novel or unique idea is needed. According to the present embodiment, a displacement permitting mechanism is provided at at least one of: a portion (attachment portion) which attaches the magnetic-path forming portion 52 to the back post 9; the movable unit 100; and the second-end-portion connector 110. Hereinafter, various examples of the displacement permitting mechanism will be explained.

Referring to FIGS. 5 and 6, there will be explained examples in which the displacement permitting mechanism is provided at the second-end-portion connector 110.

Figure 5A:
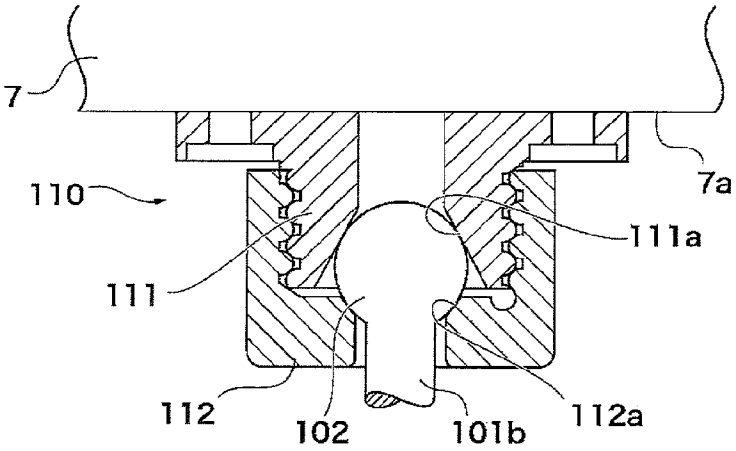
FIG. 5A is a vertical sectional view showing a second-end-portion connector relating to a displacement permitting mechanism according to a first example.
Figure 5B:
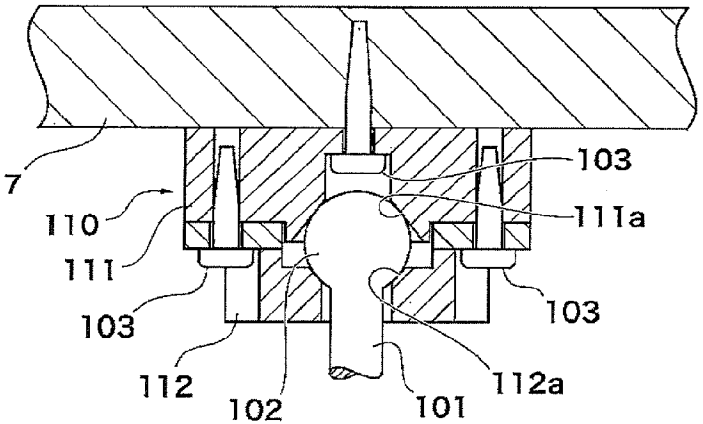
FIG. 5B is a vertical sectional view showing the second-end-portion connector relating to the displacement permitting mechanism according to a second example.
Figure 5C:
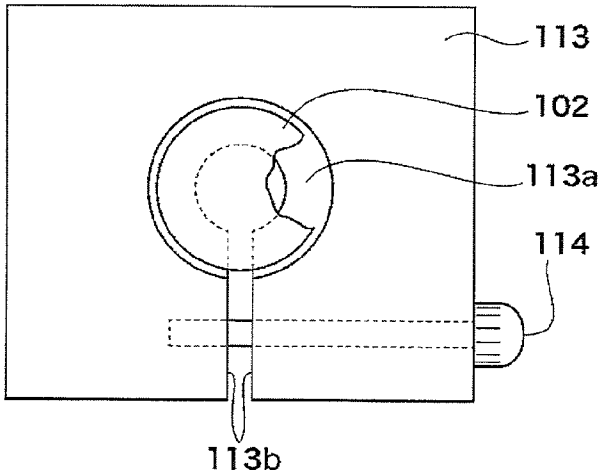
FIGS. 5C and 5D are a plan view and a vertical sectional view each showing the second-end-portion connector relating to the displacement permitting mechanism according to a third example.
Figure 5D:
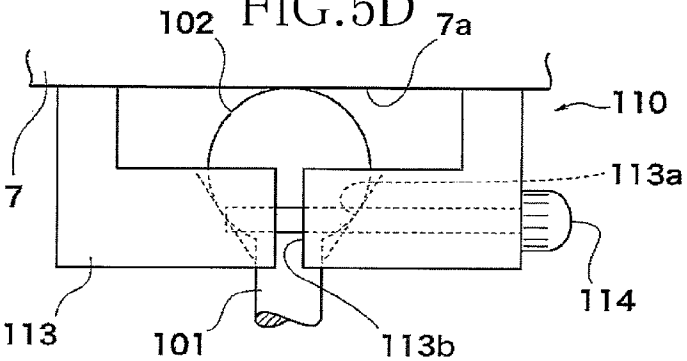

FIG. 5A is a vertical sectional view showing the second-end-portion connector 110 relating to the displacement permitting mechanism according to a first example, and FIG. 5B is a vertical sectional view showing the second-end-portion connector 110 relating to the displacement permitting mechanism according to a second example. FIGS. 5C and 5D are a plan view and a vertical sectional view each showing the second-end-portion connector 110 relating to the displacement permitting mechanism according to a third example.

As shown in FIG. 5A, the second-end-portion connector 110 according to the first example employs a ball joint structure having a pointer member 111 and a chuck member 112. The rod member 101 has a spherical portion 102 formed at the second end portion 101*b*. The pointer member 111 is fixed by screwing or the like to a lower surface 7*a* of the soundboard 7, and the chuck member 112 is threadedly engaged with the pointer member 111.

The spherical portion 102 of the rod member 101 is interposed between a tapered surface 111*a* (as one example of a contact surface) of the pointer member 111 and a tapered surface 112*a* (as one example of a contact surface) of the chuck member 112. The chuck member 112 is threadedly fastened to the pointer member 111, whereby the position of the spherical portion 102 in the Z direction is determined or defined by the tapered surface 111*a* and the tapered surface 112*a*. In this state, the spherical portion 102 is held in contact with the tapered surfaces 111*a*, 112*a*.

According to the structure described above, when the second-end-portion connector 110 is displaced in a direction including a component of the horizontal direction (as one example of a direction different from a vibration direction in which the movable unit 100 vibrates, namely, a direction intersecting the vibration direction), the spherical portion 102 can accordingly rotate about an axis perpendicular to the Z axis in the tapered surfaces 111*a*, 112*a*. Consequently, at least a portion of the rod member 101 near the second end portion 101*b* is permitted to be inclined relative to the Z axis without an excessively large force applied to the portion of the rod member 101 near to the second end portion 101*b*. Also in this state, the spherical portion 102 is held in contact with the tapered surfaces 111*a*, 112*a*.

A range that is assumed to be a range of the displacement of the second-end-portion connector 110 in the horizontal direction is defined as a "predetermined range". In the first example, the electromagnetic coupling portion EM can also incline relative to the axis C1 of the magnetic-path forming portion 52. Here, the length of the rod member 101, the size of the magnetic-path space 525, and so on, are set such that the degree of inclination of the electromagnetic coupling portion EM caused by the displacement of the second-end-portion connector 110 within the predetermined range is held within a range in which electromagnetic coupling between the magnetic-path forming portion 52 and the electromagnetic coupling portion EM is properly maintained.

Owing to the structure described above, even when the soundboard 7 undergoes a dimensional change in the horizontal direction, it is possible to maintain the vibrating function of the acoustic transducer 50 with respect to the soundboard 7. Further, the ball joint structure is configured such that the spherical portion 102 is kept in contact with the tapered surface 111*a* and the tapered surface 112*a*, so that it is possible to maintain the vibrating function of the acoustic transducer 50 with respect to the soundboard 7.

As shown in FIG. 5B, the second-end-portion connector 110 according to the second example differs from that according to the first example in the fastening structure of the pointer member 111 and the chuck member 112. The pointer member 111 is fixed to the soundboard 7 by a screw 103, and the chuck member 112 is fixed, at its flange, to the pointer member 111 by screws 103. As in the above first example, the position of the spherical portion 102 in the Z direction is determined or defined by the tapered surface 111*a* and the tapered surface 112*a*. Further, the advantages obtained in an instance where the second-end-portion connector 110 is displaced in the horizontal direction are the same as those in the first example.

As shown in FIGS. 5C and 5D, the second-end-portion connector 110 according to the third example includes a retainer 113 fixed to the soundboard 7. The retainer 113 has two extensions split by a slit 113*b*. The spherical portion 102 is disposed on a tapered surface 113*a* formed in the retainer 113, and the two extensions are fastened by a screw 114 so as to reduce the size of the slit 113*b*. Thus, the position of the spherical portion 102 in the Z direction is defined by the lower surface 7*a* of the soundboard 7 and the tapered surface 113*a*. The advantages obtained in an instance where the second-end-portion connector 110 is displaced in the horizontal direction are the same as those in the first example.

Figure 6A:
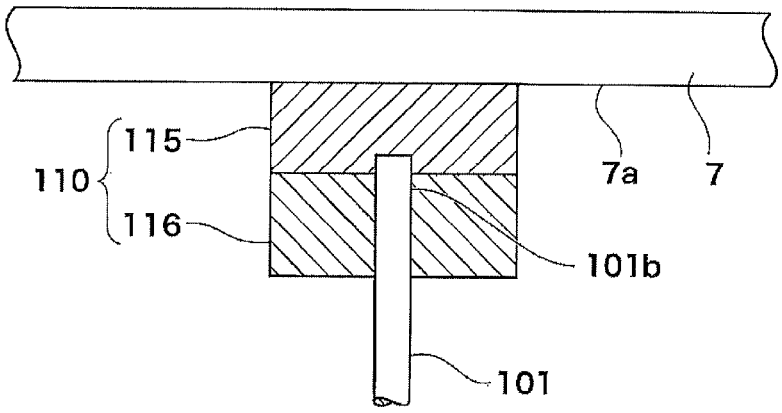
FIG. 6A is a vertical sectional view showing the second-end-portion connector relating to the displacement permitting mechanism according to a fourth example and FIG. 6B is a vertical sectional view showing the second-end-portion connector relating to the displacement permitting mechanism according to a fifth example.
Figure 6B:
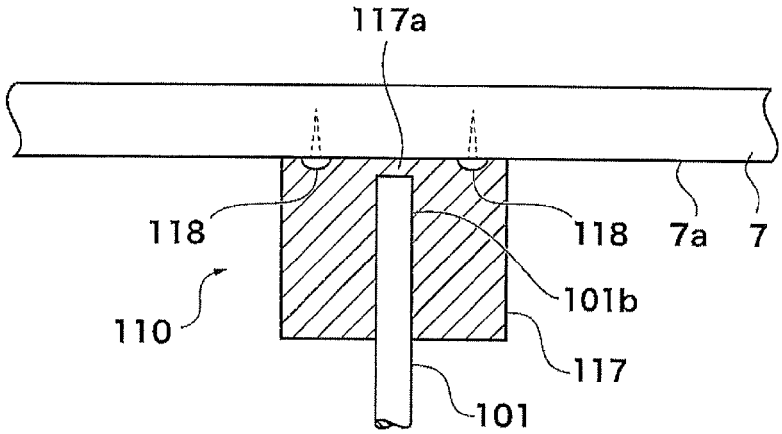

FIG. 6A is a vertical sectional view showing the second-end-portion connector 110 relating to the displacement permitting mechanism according to a fourth example, and FIG. 6B is a vertical sectional view showing the second-end-portion connector 110 relating to the displacement permitting mechanism according to a fifth example.

As shown in FIG. 6A, the second-end-portion connector 110 according to the fourth example is formed by superposing two materials having mutually different hardness in the vertical direction. For instance, an upper resin portion 115 is fixed to the lower surface 7*a* of the soundboard 7 while a lower resin portion 116 is fixed to the resin portion 115. The resin portion 115 is harder than the resin portion 116. The second end portion 101*b* of the rod member 101 is fixed to the resin portion 115 such that a distal end of the second end portion 101*b* is embedded in the resin portion 115 by a slight amount. The second-end-portion connector 110 constituted by the resin portions 115, 116 can be provided according to an outsert molding process by double molding, for instance.

The resin portion 115 has hardness that permits the vibration of the movable unit 100 to be properly transmitted to the soundboard 7. The resin portion 116 has flexibility that permits deformation thereof following a horizontal displacement of a portion of the second end portion 101*b* fixedly embedded in the resin portion 116 when the embedded portion is displaced in the horizontal direction.

According to the above structure, when the second-end-portion connector 110, specifically, the resin portion 115, is displaced in the horizontal direction, a portion of the second end portion 101*b* that is fixed to the resin portion 115 is horizontally displaced together with the resin portion 115 while the other portion located below the portion fixed to the resin portion 115 rotates about an axis perpendicular to the Z axis owing to the flexibility of the resin portion 116. Thus, a portion of the rod portion 101 other than the portion thereof fixed to the resin portion 115 is permitted to be inclined relative to the Z axis without an excessively large force applied thereto.

If the displacement of the second-end-portion connector 110 is held within the predetermined range, electromagnetic coupling between the magnetic-path forming portion 52 and the electromagnetic coupling portion EM does not become improper due to inclination of the rod member 101 caused by the displacement of the second-end-portion connector 110. Consequently, even when the soundboard 7 undergoes a dimensional change in the horizontal direction, it is possible to maintain the vibrating function of the acoustic transducer 50 with respect to the soundboard 7.

As shown in FIG. 6B, the second-end-portion connector 110 according to the fifth example is formed of a soft material of one kind. That is, a resin portion 117 having the same degree of hardness as the resin portion 116 is fixed to the lower surface 7*a* of the soundboard 7 with screws or the like. The second end portion 101*b* of the rod member 101 is fixedly embedded deeply in the resin portion 117 while leaving a small thickness portion 117*a* between the distal end of the second end portion 101*b* and the lower surface 7*a* of the soundboard 7. The thickness of the small thickness portion 117*a* is determined so as to permit the vibration of the movable unit 100 to be properly transmitted to the soundboard 7 in view of the softness of the resin portion 117.

According to the structure described above, when the second-end-portion connector 110, specifically, the upper part of the resin portion 117, is displaced in the horizontal direction, the rod member 101 is permitted to be inclined relative to the Z axis owing to the flexibility of the resin portion 117 without excessively large force applied to the rod member 101. If the displacement of the second-end-portion connector 110 is held within the predetermined range, electromagnetic coupling between the magnetic-path forming portion 52 and the electromagnetic coupling portion EM does not become improper due to inclination of the rod member 101 caused by the displacement of the second-end-portion connector 110. Consequently, even when the soundboard 7 undergoes a dimensional change in the horizontal direction, it is possible to maintain the vibrating function of the acoustic transducer 50 with respect to the soundboard 7.

While substantially the entirety of the rod member 101 can be inclined in the examples shown in FIGS. 5 and 6 when the second-end-portion connector 110 is displaced, substantially the entirety of the rod member 101 need not be inclined. That is, it is at least required that the connected state of the second end portion 101*b* with respect to the soundboard 7 by the second-end-portion connector 110 be maintained by the displacement permitting mechanism that permits inclination of at least a portion of the rod member 101 near the second end portion 101*b* with respect to the Z direction such that the vibration of the movable unit 100 can be transmitted to the soundboard 7.

Figure 7:
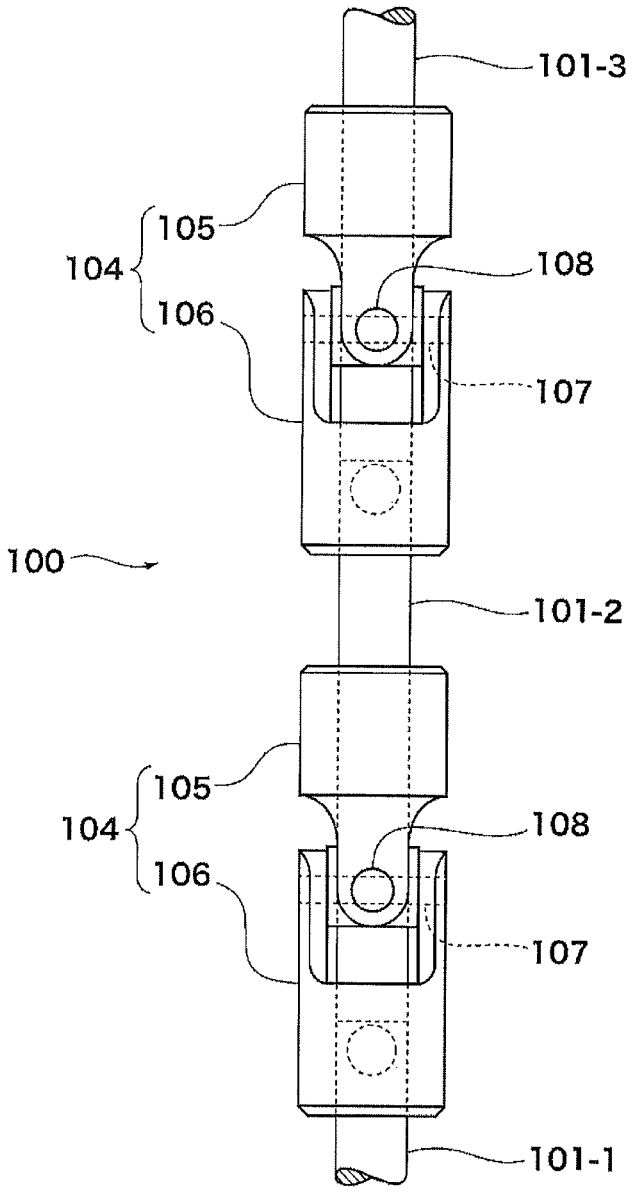
FIG. 7 is a side view of a rod member of a movable unit relating to the displacement permitting mechanism according to a sixth example.

Referring next to FIGS. 7-9, there will be explained examples in which the displacement permitting mechanism is provided at the movable unit 100.

FIG. 7 is a side view of the rod member 101 of the movable unit 100 relating to the displacement permitting mechanism according to a sixth example. In the movable unit 100 according to the sixth example, the rod member 101 is divided into three portions in the up-down direction, i.e., a first rod portion 101-1, a second rod portion 101-2, and a third rod portion 101-3. The first rod portion 101-1 and the second rod portion 101-2 are connected by one universal joint 104, and the second rod portion 101-2 and the third rod portion 101-3 are connected by another universal joint 104. Each universal joint 104 is one example of a connect portion. The two universal joints 104 function as the displacement permitting mechanism. A yoke 106 is connected to an upper end portion of the first rod portion 101-1 while a yoke 105 is connected to a lower end portion of the second rod portion 101-2. Between the yokes 105, 106, a cross 107, 108 is disposed. A yoke 106 is connected to an upper end portion of the second rod portion 101-2 while a yoke 105 is connected to a lower end portion of the third rod portion 101-3. Between the yokes 105, 106, a cross 107, 108 is disposed.

The connect portion between the first rod portion 101-1 and the second rod portion 101-2 is focused, for instance. The second rod portion 101-2 is rotatable relative to the first rod portion 101-1 about the X axis and about the Y axis, by the universal joint 104. Consequently, even when the axis of the first rod portion 101-1 and the axis of the second rod portion 101-2 are inclined relative to each other, a force can be transmitted in the Z direction.

According to this structure, the universal joint 104 permits the second rod portion 101-2 to be inclined relative to the first rod portion 101-1 even when the second-end-portion connector 110 is displaced with respect to the back post 9 in the horizontal direction. Consequently, the connected state of the rod members 101-1, 101-2 is maintained such that the vibration of the movable unit 100 can be transmitted to the soundboard 7. Even when the first rod portion 101-1 is inclined due to the displacement of the second-end-portion connector 110 within the predetermined range, the space between the magnetic-path forming portion 52 and the electromagnetic coupling portion EM is properly maintained, so that electromagnetic coupling therebetween is also properly maintained.

Thus, the vibrating function of the acoustic transducer 50 with respect to the soundboard 7 can be maintained even when the soundboard 7 undergoes a dimensional change in the horizontal direction.

In the sixth example of FIG. 7, the rod member 101 is divided into three portions in the up-down direction. The rod member 101 may be divided into four or more portions or may be divided into two portions. In any of these cases, adjacent two divided portions of the rod member 101 need to be connected by the universal joint 104. Further, the mechanism for connecting adjacent portions of the rod member 101 so as to allow inclination thereof relative to each other is not limited to the mechanism or unit called "universal joint".

Figure 8A:
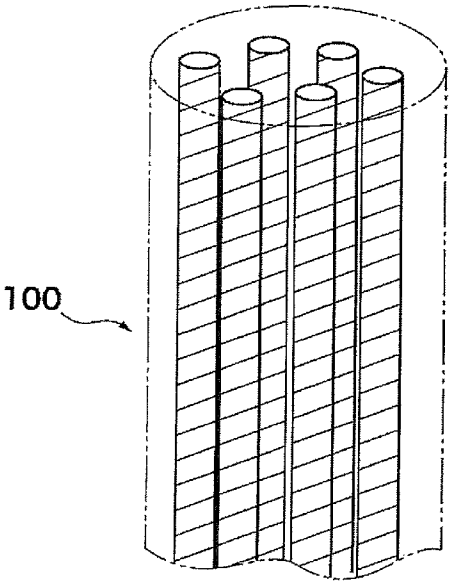
FIG. 8A is a perspective view showing an end portion of the rod member of the movable unit relating to the displacement permitting mechanism according to a seventh example.

FIG. 8A is a perspective view showing an end portion of the rod member 101 of the movable unit 100 relating to the displacement permitting mechanism according to a seventh example.

Figure 8B:
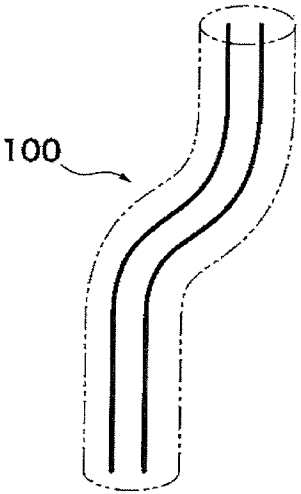
FIG. 8B is a perspective view showing an entirety of the rod member.

In the seventh example, the displacement permitting mechanism is applied to the rod member 101 per se of the movable unit 100. The rod member 101 has an internal structure in which a plurality of iron cores extend in a soft resin as a base material. For instance, a carbon fiber or the like can be used. The thus formed rod member 101 has flexibility in the horizontal direction while keeping strength in the Z direction. Consequently, even when the second-end-portion connector 110 is displaced with respect to the back post 9 in the horizontal direction within the predetermined range, the rod member 101 is bent as shown in FIG. 8B and the space between the magnetic-path forming portion 52 and the electromagnetic coupling portion EM is properly maintained, so that electromagnetic coupling therebetween is also properly maintained.

Figure 8C:
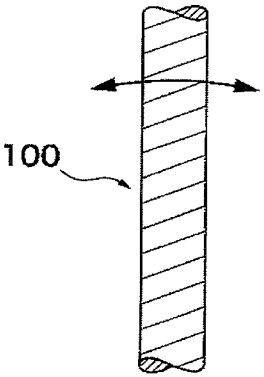
FIG. 8C is a side view showing the rod member of the movable unit relating to the displacement permitting mechanism according to an eighth example.
Figure 8D:
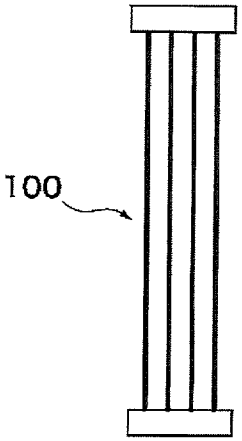
FIG. 8D is a side view showing the rod member of the movable unit relating to the displacement permitting mechanism according to a ninth example.

FIG. 8C is a side view showing the rod member 101 of the movable unit 100 relating to the displacement permitting mechanism according to an eighth example, and FIG. 8D is a side view showing the rod member 101 of the movable unit 100 relating to the displacement permitting mechanism according to a ninth example. The rod member 101 of the movable unit 100 according to the eighth example of FIG. 8C is constituted by a flexible shaft. The rod member 101 of the movable unit 100 according to the ninth example of FIG. 8D is formed by a plurality of wires whose opposite ends are fixed. The eighth and ninth examples also ensure the same advantages as in the seventh example.

Figure 9A:
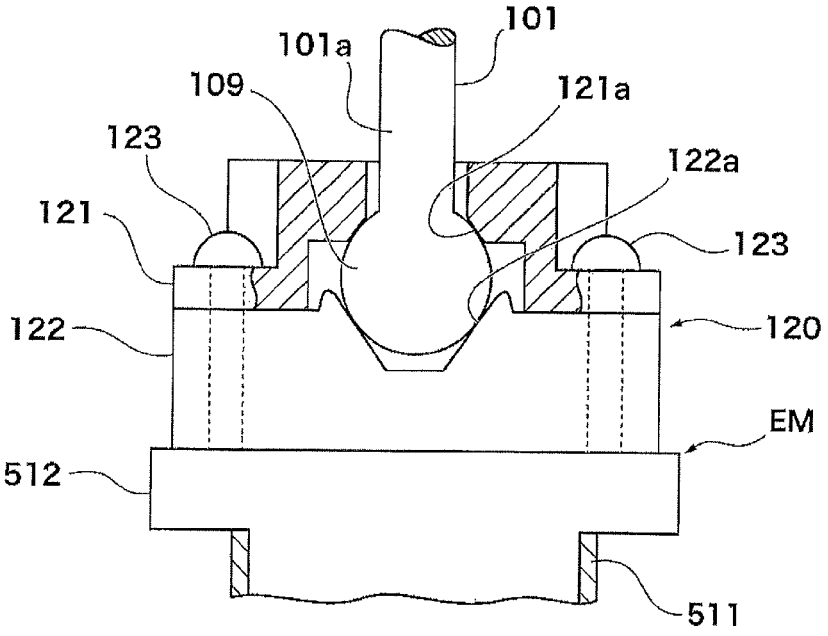
FIG. 9A is a vertical sectional view showing a portion of the movable unit relating to the displacement permitting mechanism according to a tenth example, the portion connecting a first end portion of the rod member and an electromagnetic coupling portion.

FIG. 9A is a vertical sectional view showing a portion of the movable unit 100 relating to the displacement permitting mechanism according to a tenth example, the portion connecting the electromagnetic coupling portion EM and the first end portion 101*a* of the rod member.

In the tenth example, the displacement permitting mechanism is applied to a first-end-portion connector 120 connecting the electromagnetic coupling portion EM and the first end portion 101*a* of the rod member 101. The first-end-portion connector 120 is similar in construction to the second-end-portion connector 110 of the second example shown in FIG. 5B and differs from the second-end-portion connector 110 of the second example in that the first-end-portion connector 120 is provided near the first end portion 101*a* of the rod member 101.

A spherical portion 109 is formed at the first end portion 101*a* of the rod member 101. A lower member 122 is fixed to the cap 512 by bonding or by screws not shown while an upper member 121 is fixed to the lower member 122 by screws 123. The position of the spherical portion 109 in the Z direction is defined by a tapered surface 121*a* of the upper member 121 and a tapered surface 122*a* of the lower member 122.

According to this structure, even when the second-end-portion connector 110 is displaced within the predetermined range, the first-end-portion connector 120 permits at least a portion of the rod member 101 near the first end portion 101*a* to be inclined relative to the Z direction, whereby the connected state of the first end portion 101*a* with respect to the electromagnetic coupling portion EM is maintained such that the vibration of the movable unit 100 can be transmitted to the soundboard 7. In this instance, the space between the magnetic-path forming portion 52 and the electromagnetic coupling portion EM is properly maintained and electromagnetic coupling therebetween is also properly maintained as long as the displacement of the second-end-portion connector 110 is held within the predetermined range.

Figure 9B:
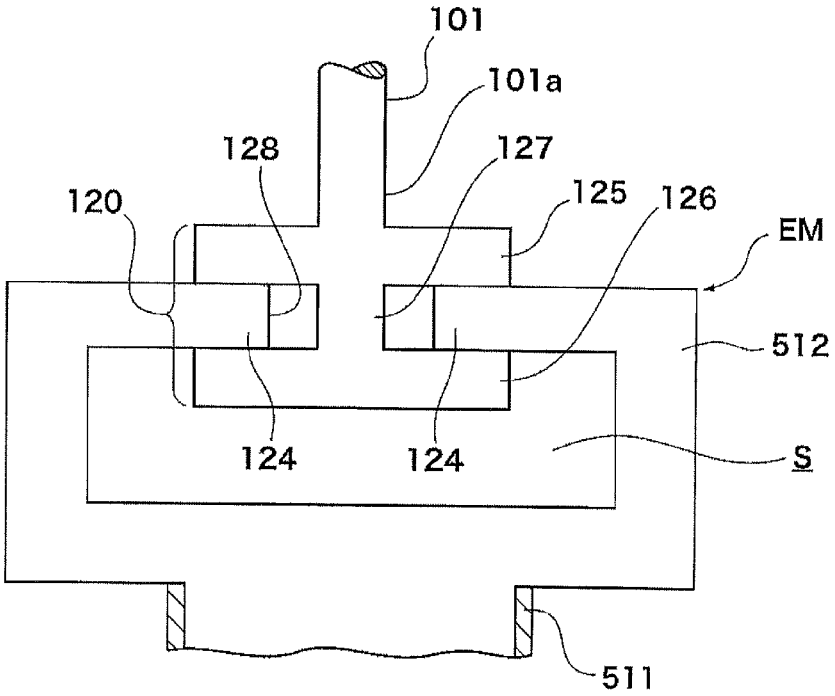
FIG. 9B is a vertical sectional view showing a portion of the movable unit relating to the displacement permitting mechanism according to an eleventh example, the portion connecting the first end portion of the rod member and the electromagnetic coupling portion.

FIG. 9B is a vertical sectional view showing a portion of the movable unit 100 relating to the displacement permitting mechanism according to an eleventh example, the portion connecting the first end portion 101*a* of the rod member 101 and the electromagnetic coupling portion. In the eleventh example, the displacement permitting mechanism is applied to the first-end-portion connector 120 connecting the electromagnetic coupling portion EM and the first end portion 101*a* of the rod member 101.

In the electromagnetic coupling portion EM, the cap 512 is provided with an inwardly extending portion 124 that extends radially inwardly. A space S is formed under the inwardly extending portion 124, and the inner diameter of the inwardly extending portion 124 defines a circular relief portion 128. In the first-end-portion connector 120, an upper-side outwardly extending portion 125 and a lower-side outwardly extending portion 126 are formed at the lower portion of the first end portion 101*a* so as to extend from a shaft portion 127 radially outwardly. The outer diameter of the upper-side outwardly extending portion 125 and the lower-side outwardly extending portion 126 is larger than the relief portion 128.

The inwardly extending portion 124 is held between the upper-side outwardly extending portion 125 and the lower-side outwardly extending portion 126 so as to be slidable in the horizontal direction, whereby the first-end-portion connector 120 can be displaced with respect to the cap 512 in the horizontal direction. There may be taken any suitable measure for reducing friction between: the upper-side outwardly extending portion 125 and the lower-side outwardly extending portion 126: and the inwardly extending portion 124. For instance, a lubricant may be applied between the upper-side and lower-side outwardly extending portions 125, 126 and the inwardly extending portion 124 or a bearing may be interposed therebetween. The inwardly extending portion 124 and the upper-side and lower-side outwardly extending portions 125, 126 are preferably configured such that the displacement amount of the first-end-portion connector 120 with respect to the cap 512 is held within a certain range.

According to the structure described above, even when the second-end-portion connector 110 is displaced within the predetermined range, the first-end-portion connector 120 permits the rod member 101 to be displaced in the horizontal direction relative to the electromagnetic coupling portion EM, together with the first-end-portion connector 120, whereby the connected state of the first end portion 101*a* with respect to the electromagnetic coupling portion EM is maintained such that the vibration of the movable unit 100 can be transmitted to the soundboard 7. In this instance, the space between the magnetic-path forming portion 52 and the electromagnetic coupling portion EM is properly maintained and electromagnetic coupling therebetween is also properly maintained as long as the displacement of the second-end-portion connector 110 is held within the predetermined range.

According to the tenth and eleventh examples described above, even when the soundboard 7 undergoes a dimensional change in the horizontal direction, it is possible to maintain the vibrating function of the acoustic transducer 50 with respect to the soundboard 7.

Figure 10:
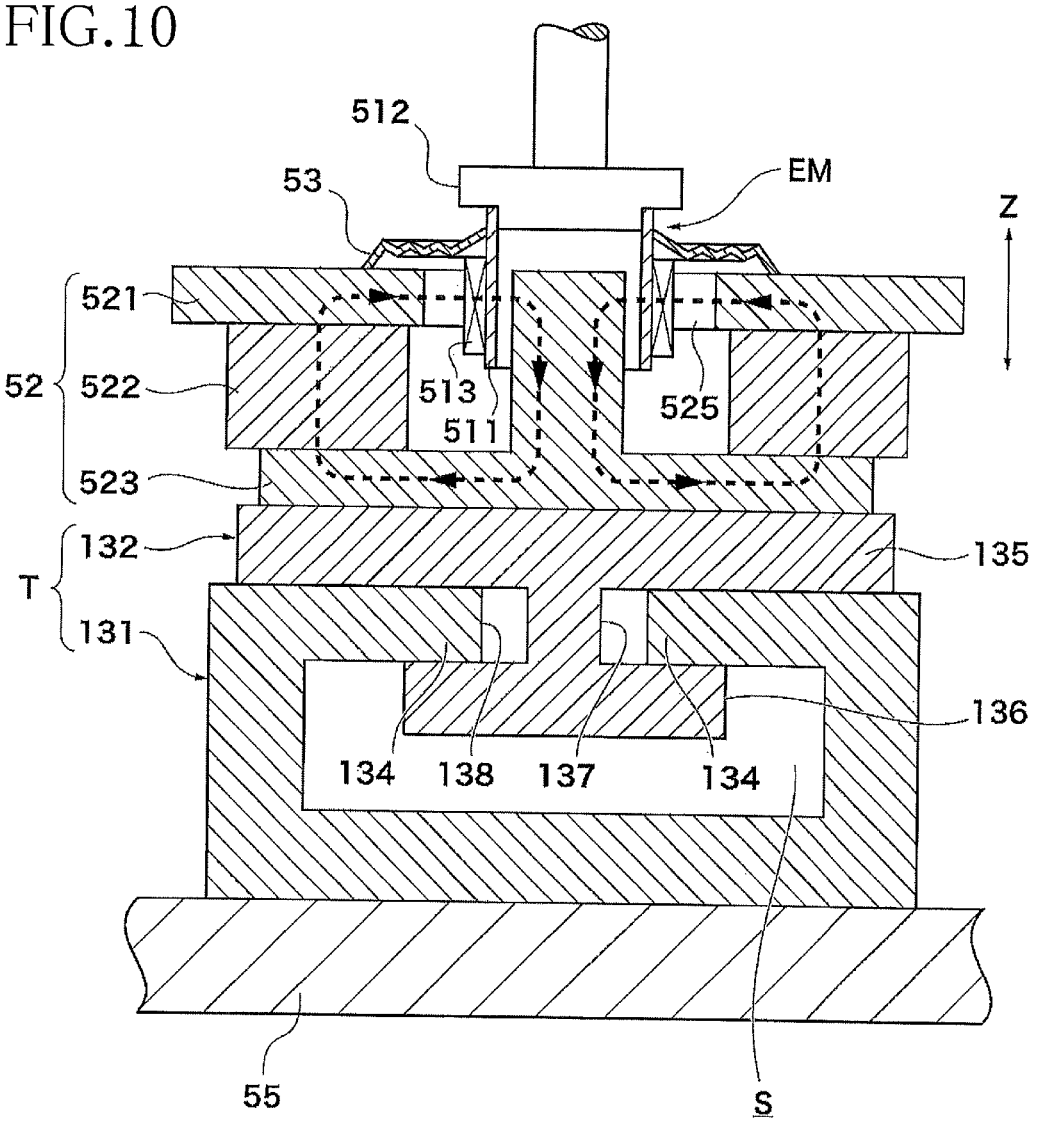
FIG. 10 is a vertical sectional view showing an attachment portion relating to the displacement permitting mechanism according to a twelfth example.

Referring next to FIG. 10, there will be explained a structure in which the displacement permitting mechanism is provided at an attachment portion which attaches the magnetic-path forming portion 52 to the back post 9.

FIG. 10 is a vertical sectional view showing an attachment portion relating to the displacement permitting mechanism according to a twelfth example. The magnetic-path forming portion 52 is attached to the support member 55 by the attachment portion T. Therefore, the attachment portion T interposed between the support member 55 and the magnetic-path forming portion 52 cooperates with the support member 55 to attach the magnetic-path forming portion 52 to the back post 9.

The attachment portion T has a structure similar to that of the cap 512 and the first-end-portion connector 120 shown in FIG. 9B. Specifically, the attachment portion T includes a lower member 131 and an upper member 132. The lower member 131 is fixed to the support member 55 by screwing or the like. The magnetic-path forming portion 52 is fixed onto the upper member 132.

The lower member 131 is provided with an inwardly extending portion 134 that extends radially inwardly. A space S is formed under the inwardly extending portion 134, and the inner diameter of the inwardly extending portion 134 defines a circular relief portion 138. The upper member 132 is provided with an upper-side outwardly extending portion 135 and a lower-side outwardly extending portion 136 that extend from a shaft portion 137 radially outwardly. The outer diameters of the upper-side outwardly extending portion 135 and the lower-side outwardly extending portion 136 are larger than the relief portion 138.

The inwardly extending portion 134 is held between the upper-side outwardly extending portion 135 and the lower-side outwardly extending portion 136 so as to be slidable in the horizontal direction, whereby the upper member 132 can be displaced relative to the lower member 131 in the horizontal direction. As in the eleventh example shown in FIG. 9B, any suitable friction reducing measure or any mechanism for restricting the displacement amount may be provided.

According the structure described above, even when the second-end-portion connector 110 is displaced within the predetermined range, the attachment portion T permits the magnetic-path forming portion 52 to be displaced relative to the back post 9 in the horizontal direction, whereby the attached state of the magnetic-path forming portion 52 with respect to the back post 9 is maintained such that the vibration of the movable unit 100 can be transmitted to the soundboard 7. In this instance, the space between the magnetic-path forming portion 52 and the electromagnetic coupling portion EM is properly maintained and electromagnetic coupling therebetween is also properly maintained as long as the displacement of the second-end-portion connector 110 is held within the predetermined range.

According to the twelfth example, even when the soundboard 7 undergoes a dimensional change in the horizontal direction, it is possible to maintain the vibrating function of the acoustic transducer 50 with respect to the soundboard 7.

The structure shown in each of FIG. 9B and FIG. 10 in which two constituent elements can be displaced relative to each other in the horizontal direction is not limited to those illustrated above. For instance, a combination of a groove and a protrusion may be provided in both of the X axis and the Y axis.

According to the present embodiment, the displacement permitting mechanism is provided at at least one of the attachment portion T, the movable unit 100, and the second-end-portion connector 110, whereby the vibrating function of the acoustic transducer 50 with respect to the soundboard 7 can be properly maintained even when the soundboard 7 undergoes a dimensional change in the direction perpendicular to the vibration direction of the movable unit 100 (as one example of the intersecting direction).

For the displacement permitting mechanism according to any one of the first through fifth examples (FIG. 5 and FIG. 6), the displacement permitting mechanism according to the sixth example (FIG. 7), the displacement permitting mechanism according to any one of the tenth and eleventh examples (FIG. 9), and the displacement permitting mechanism according to the twelfth example (FIG. 10), at least one of those may be employed or two or more of those may employed as one displacement permitting mechanism.

In the embodiment described above, the soundboard 7 is illustrated as one example of the vibrated body to be vibrated. In addition, the invention is applicable to a structure in which any other member such as a roof or a side board that undergoes a dimensional change functions as the vibrated body to be vibrated. Even in an instance where the vibrated body does not undergo the dimensional change, the invention is applicable when a member that supports the acoustic transducer undergoes the dimensional change or deformation in a direction different from or intersecting the vibration direction.

In the embodiment described above, the displacement permitting mechanism is configured to permit the vibrated body to be displaced in the X direction and the Y direction. The displacement permitting mechanism may be configured to permit the vibrated body to be displaced also in the Z direction, in addition to the X direction and/or the Y direction, as long as the vibration applied from the vibrating unit 100 is not interfered.

The piano to which the principle of the invention is applicable may be a grand piano or an upright piano. The invention is applicable to not only pianos but also various acoustic musical instruments having the acoustic transducer, electronic musical instruments having the acoustic transducer, and speakers. When the invention is applied to the acoustic musical instruments, the electronic musical instruments, and the speakers, the vibrated body that can be forcibly vibrated needs to be provided therein. The invention is applicable to any structure in which the position at which the vibrated body is connected to the movable unit and the position at which the acoustic transducer is supported relatively shift in a direction different from vibration direction due to a dimensional change or the like.

DESCRIPTION OF REFERENCE SIGNS

7: soundboard (vibrated body), 9: back post (fixed portion), 50: acoustic transducer, 52: magnetic-path forming portion, 100: movable unit, 101: rod member, 101*a*: first end portion, 101*b*: second end portion, 101-1: first rod portion (second portion), 101-2: second rod portion (first portion), 101-3: third rod portion (second portion), 104: universal joint (connect portion), 110: second-end-portion connector, 120: first-end-portion connector, 511: bobbin, 513: voice coil, EM: electromagnetic coupling portion, T: attachment portion

The invention claimed is:

1. An installation structure for an acoustic transducer configured to operate in accordance with an audio signal to vibrate a vibrated body in a first direction, the installation structure comprising:

a magnetic-path forming portion forming a magnetic path;

a movable unit having an electromagnetic coupling portion electromagnetically coupled to the magnetic-path forming portion, the movable unit being configured to vibrate in the first direction when the electromagnetic coupling portion is driven by the magnetic-path forming portion in response to a drive signal based on the audio signal;

an attachment portion that attaches the magnetic-path forming portion to a fixed portion;

a connector connected to the vibrated body, the connector connecting the movable unit to the vibrated body fixedly in the first direction for transmitting vibration of the movable unit to the vibrated body and having at least one contact surface and a chuck member; and a displacement permitting mechanism configured to, when the connector is displaced with respect to the fixed portion within a predetermined range in an intersecting direction that intersects the first direction, permit electromagnetic coupling between the magnetic-path forming portion and the electromagnetic coupling portion to be maintained and permit the vibration of the movable unit to be transmitted to the vibrated body, wherein the displacement permitting mechanism is provided at at least one of the movable unit or the connector, wherein the movable unit comprises a rod member having a first end portion connected to the electromagnetic coupling portion, and a second end portion connected to the connector and having a spherical portion, wherein the displacement permitting mechanism comprises:

the spherical portion; and the at least one contact surface held in contact with the spherical portion when the connector is displaced with respect to the magnetic-path forming portion within the predetermined range in the intersecting direction, and wherein the chuck member holds the spherical portion so that the spherical portion is held in contact with the at least one contact surface.

2. The installation structure for the acoustic transducer according to claim 1, wherein the displacement permitting mechanism is configured so that, when the connector is displaced with respect to the fixed portion within the predetermined range, the displacement permitting mechanism permits the rod member to be relatively displaced with respect to the electromagnetic coupling portion in the intersecting direction.

3. The installation structure for the acoustic transducer according to claim 1, wherein the displacement permitting mechanism is configured so that, when the connector is displaced with respect to the magnetic-path forming portion within the predetermined range in the intersecting direction, the displacement permitting mechanism permits the second end portion of the rod member to be connected to the connector in a state in which the rod member is inclined with respect to the first direction.

4. The installation structure for the acoustic transducer according to claim 1, wherein:

the connector further comprises a pointer member fixed to the vibrated body, the pointer member includes the at least one contact surface having a tapered surface, and the chuck member is engaged with the pointer member so that the spherical portion is held in contact with the tapered surface of the pointer member.

5. The installation structure for the acoustic transducer according to claim 4, wherein:

the chuck member also has a tapered surface, and the chuck member is engaged with the pointer member so that the spherical portion is disposed and held between the tapered surface of the chuck member and the tapered surface of the pointer member.

* * * * *